United States Patent [19]

Defago

[11] 4,167,392

[45] Sep. 11, 1979

[54] TRANSFER PRINTING PROCESS FOR HYDROPHILIC FIBROUS MATERIAL OR BLENDS OF HYDROPHILIC AND SYNTHETIC FIBROUS MATERIAL, WITH REACTIVE DISPERSE DYES

[75] Inventor: Raymond Defago, Riehen, Switzerland

[73] Assignee: Ciba-Geigy AG, Basel, Switzerland

[21] Appl. No.: 645,475

[22] Filed: Dec. 30, 1975

[30] Foreign Application Priority Data

Dec. 30, 1974 [CH] Switzerland ..... 17365/74
Oct. 3, 1975 [CH] Switzerland ..... 12856/75

[51] Int. Cl.[2] ..... D06P 3/66

[52] U.S. Cl. ..... 8/2.5 A; 8/1 A; 8/1 S; 8/21 B; 8/21 C; 8/21 R; 8/22; 8/54.2; 8/85 R; 8/85 B; 8/88; 8/93; 106/22; 427/148; 428/195; 428/537; 428/411; 428/457; 428/913

[58] Field of Search ..... 8/21 R, 22, 54, 54.2, 8/62, 85 R, 85 B, 1 S, 1 A, 2.5 A, 85, 88, 93, 21 B, 21 C

[56] References Cited

U.S. PATENT DOCUMENTS

| | | | |
|---|---|---|---|
| 2,290,945 | 7/1942 | Dahlen et al. | 8/85 B |
| 2,770,534 | 11/1956 | Marx | 8/2.5 |
| 3,034,918 | 5/1962 | Cook et al. | 8/2.5 A |
| 3,649,280 | 3/1972 | King et al. | 96/66 T |
| 3,666,397 | 5/1972 | Datye et al. | 8/2.5 |

FOREIGN PATENT DOCUMENTS

| | | |
|---|---|---|
| 813881 | 10/1974 | Belgium . |
| 2456637 | 6/1975 | Fed. Rep. of Germany . |
| 1403119 | 8/1975 | United Kingdom . |
| 1463682 | 2/1977 | United Kingdom . |

OTHER PUBLICATIONS

C. E. Vellins, "Transfer Printing" in Venkataraman's The Chemistry of Synthetic Dyes, vol. VIII, (Academic Press), 1978, pp. 191-220.

*Primary Examiner*—A. Lionel Clingman
*Attorney, Agent, or Firm*—Wenderoth, Lind & Ponack

[57] ABSTRACT

A transfer printing process for dyeing or optically brightening hydrophilic fibrous material and blends of hydrophilic and synthetic fibrous material with sublimable reactive disperse dyes or fluorescent brighteners, which process comprises the use of inert carriers that are treated with at least one reactive disperse dye or fluorescent brightener, which, during the heat treatment of the transfer printing process, has a vapor pressure higher than $10^{-5}$ Torr at temperatures above 160° C., and treating the material to be printed with at least two compounds, one of which has a boiling point higher than 120° C. and a solubility or dispersibility in water of at least 25 g/l at 25° C., direct or with the aid of an auxiliary solvent or dispersant, and under the transfer conditions of the dyes or fluorescent brighteners is sparingly volatile, and the other is an acid acceptor, or with at least one compound that combines both functions simultaneously.

17 Claims, No Drawings

TRANSFER PRINTING PROCESS FOR HYDROPHILIC FIBROUS MATERIAL OR BLENDS OF HYDROPHILIC AND SYNTHETIC FIBROUS MATERIAL, WITH REACTIVE DISPERSE DYES

It is known to produce transfer prints on woven or knitted textile fabrics by printing a carrier, usually paper, with an aqueous or preferably an organic, virtually anhydrous printing ink prepared from sublimable disperse dyes that are sparingly soluble in water, then pressing the printed paper and the fabric together at a temperature at which the dye sublimes, is transferred to the fabric, and diffuses into the fibres. Using this transfer printing process, it is possible to produce solid shade dyeing effects as well as complicated patterns without the necessity of having to use expensive printing machines in this stage.

Appropriate processes are described, for example, in French Pat. Nos. 1.223.330 and 1.334.829 as well as in Swiss patent 476.893. However, all these processes relate to the printing of hydrophobic synthetic fibres, such as cellulose acetate, synthetic polyamides, acrylonitrile, and, especially, polyesters. Since the sublimable dyes used hitherto for the transfer printing have no, or at least little, affinity for hydrophilic fibres, especially cotton and regenerated cellulose fibres, it has not been possible to print these materials by the known transfer printing processes.

Wet transfer printing processes are also known in which the transfer of the dye is effected not by sublimation, but by means of a simple contact transfer. These processes therefore make much smaller demands on the choice of the dyes and also because, inter alia, the inclusion of a subsequent step, for example a dye fixation step, is not detrimental on account of the already moist printing substrate. Such processes are disclosed, for example, in German Offenlegungnsschriften Nos. 1.912.632 and 2.406.186.

Belgian patent 813.881 discloses a transfer printing process for printing textile material of cellulose and other polyhydroxylated fibres which comprises using sublimable organic dyes or fluorescent brighteners and wherein the material to be printed is impregnated with an aqueous solution of at least one organic compound which (a) has a boiling point higher than 120° C., (b) has a solubility in water of at least 25 g/l at 25° C., either direct or with the aid of an auxiliary solvent, and (c) under the transfer conditions of the dyes or fluorescent brighteners is spargingly volatile yet fluid and does not decompose.

Belgian Patent No. 822.832 and Swiss patent application No. 9638/74 also disclose a transfer printing process for dyeing or optionally brightening hydrophilic fibrous material, or blends of hydrophilic and synthetic fibrous material, with transferable dyes or fluorescent brighteners, which comprises the use of inert carriers that are treated with at least one compound which splits off water during the heat treatment of the transfer printing process and is converted into a compound with a vapour pressure higher than $10^{-5}$ Torr at 100° to 250° C., or with at least two compounds, one of which splits off water during the heat treatment of the transfer printing process and the other has a vapour pressure higher than $10^{-5}$ Torr at temperatures of 100° to 250° C., or which comprises the use of inert carriers that are treated with at least one transferable dye or fluorescent brightener, at least one solid compound that melts during the heat treatment of the transfer process and has a vapour pressure higher than $10^{-5}$ Torr at 150° to 250° C., and optionally with a binder that is stable below 230° C.

Furthermore, German Offenlegungsschrift No. 2.045.465 discloses a special two component pretreatment transfer printing process that consists of a special chemical reaction mechanism and comprises pretreating natural or synthetic material, in particular textile material of wool or cellulose, with polyfunctional compounds containing two to three vinyl (especially acrylic) or epoxy groups, or with the direct primary products thereof, in the presence of thio compounds, in particular thiocyanates, thioureas or thiocyanates, and, after drying it if required, dyeing or printing said material by the dry transfer printing process with disperse dyes which are converted into the vapour state at atmospheric pressure and a temperature below 240° C.

These three processes have the disadvantage that, where fibre blends are used, the solid shade dyeings obtained on the different types of fibrous material have varying fastness properties.

Accordingly, the present invention provides a process which makes it possible, in straightforward manner, to obtain strong and fast dyeings or white effects on a hydrophilic dyeing or printing substrate, and blends of a hydrophilic dyeing and printing substrate, with sublimable dyes or fluorescent brighteners by the transfer printing process, and, when using fibre blends, to dye these in solid shades and at the same time to produce strong and fast dyeings and white effects on both types of fibre, which process comprises (a) pretreating the printing substrate with at least two compounds, one of which has a boiling point higher than 120° C. and a solubility or dispersibility of at least 25 g/l in water at 25° C., directly or with the aid of an auxiliary solvent or dispersant, and is sparingly volatile under the transfer conditions of the dyes or fluorescent brighteners, and the other is an acid acceptor, or with at least one compound that combines both functions simultaneously, and (b) using a carrier that is treated with at least one reactive disperse dye or fluorescent brightener.

Particularly suitable compounds as defined herein (transfer assistants) with which the printing substrate will be pretreated according to the present invention, are those that have a vapour pressure higher than $10^{-5}$ Torr and, above all, those that contain at least one nitrogen atom in the molecule, for example amines, imides, imines, unsubstituted or substituted ureas and thioureas, and also 5- to 7-membered saturated or unsaturated heterocyclic ring compounds that possess as ring members at least one of the groups or atoms N, S, O, NH, CO, =CH, $CH_2$and which can be substituted by alkyl of 1 to 4 carbon atoms, OH, $NH_2$, hydroxyalkyl of 1 to 3 carbon atoms or halogen.

As examples there may be cited: imidazole, 2-methylimidazole, hydantoin, 1-N-hydroxymethyl-5-dimethyl hydantoin, succinimide, N-hydroxysuccinimide, nicotinic amide, pyrazinecarboxylic amide.

A particularly preferred class of compounds as defined herein are imines, especially polyethylene imines, and polyamides, for example those obtained by the Hofmann degradation of polyacrylic amides, or reaction products of polymethacrylic glycidyl ester with ammonia.

Each of these compounds alone combines both functions of the impregnation, that is to say each imparts affinity to the material to be printed for the dye and simultaneously acts as acid acceptor. In this case, it suffices to pretreat the printing substrate with only one such compound.

The optional use of mixtures of imine-amide is often advantageous, for example a mixture of polyethylene imine (molecular weight 40,000) with cyanamide in the ratio 1:1.

Preferred urea and thiourea derivatives are derived from compounds of the general formula 1

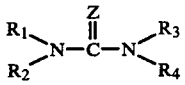

(1)

wherein Z=O or S and each of $R_1$, $R_2$, $R_3$ and $R_4$ independently represents hydrogen, alkyl of 1 to 8 carbon atoms, cycloalkyl or aryl, in particular phenyl or o-, m- or p-tolyl, and which can be substituted by OH, CN, $NH_2$, halogen, hydroxyalkyl of 1 to 3 carbon atoms.

Alkyl radicals represented by each of $R_1$ or $R_4$ can be straightchain or branched, or $R_1$ and $R_2$ or $R_3$ and $R_4$, together with the nitrogen atom to which they are attached, or $R_1$ and $R_3$ or $R_2$ and $R_4$, together with the bridge member N-CZ-N- to which they are attached, form a heterocyclic ring which can contain further heteroatoms, for example oxygen, sulphur or nitrogen atoms. These alkyl radicals can also be substituted, for example they can contain aryl radicals, in which case they then represent, for example, a benzyl group.

Where $R_1$ and $R_2$ or $R_3$ and $R_4$, together with the nitrogen atom to which they are attached, form a heterocyclic ring, then compounds of formula 2

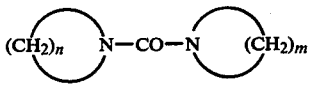

(2)

or "mixed" ureas of formula 3

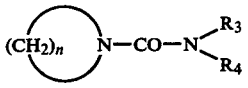

(3)

are of particular interest, wherein n and m are integers from 2 to 6 and each of $R_3$ and $R_4$ represents an alkyl radical. Compounds of formulae (2) or (3) can contain, for example, aziridine, pyrrolidine, piperidine or hexamethylenimine radicals attached to the carbonyl bridge. Where the heterocyclic ring formed by $R_1$ and $R_2$ or $R_3$ and $R_4$, together with the nitrogen atom to which they are attached, contains a further heteroatom in addition to the nitrogen atom, possible compounds are those of formulae

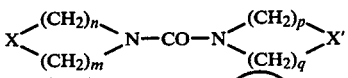

(4)

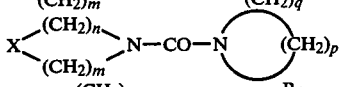

(5)

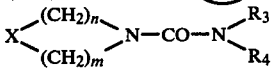

(6)

wherein each of X and X' represents an oxygen or a sulphur atom or a -NR group and R represents a hydrogen atom or an alkyl radical, $R_3$ and $R_4$ are as defined hereinbefore, and n, m, p and q are positive integers which are small; preferably n and m and p and q are the same. Important compounds of formulae (4) to (6) are those that contain a 5- to 7-membered heterocyclic radical with one or two heteroatoms, in particular a radical of formula (7)

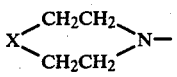

(7)

wherein X is as defined hereinbefore.

Examples of urea and thiourea derivatives are: N-ethyl urea, N-methyl urea, N-methyl thiourea, N,N'-ethylene urea, N,N'-dimethyl thiourea, 2-imidazolidone thiourea, N,N'-propylene thiourea, N-isobutyl thiourea, N,N-butylene thiourea.

Examples of amides are primarily those of the general formula $$R—C0—NH_2$$

wherein R represents aryl, especially phenyl, aralkyl, in particular benzyl, or a 5- or 7-membered saturated or unsaturated heterocyclic ring which can be substituted by halogen, in particular by chlorine or bromine, OH, CN, $NH_2$, hydroxyalkyl of 1 to 3 carbon atoms, for example nicotinic amide, anthranilic amide, 3-aminobenzamide or pyrazinecarboxylic amide.

Examples of imides are above all those of the general formula

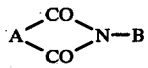

wherein A represents the —CH=CH or $(CH_2)_n$ group (n=1 to 6) which can contain halogen or OH, CN, $NH_2$ and hydroxyalkyl of 1 to 3 carbon atoms, and B represents —OH, —CN, —$NH_2$ or hydroxyalkyl of 1 to 4 carbon atoms, for example N-hydroxysuccinimide or N-hydroxymethylsuccinimide.

Further nitrogen-containing compounds which can be used according to the present invention are: N-phenyldiethanolamine, bis-(2-hydroxypropyl)-amine and tri-(hydroxymethyl)-nitromethane.

Finally, as examples of compounds which do not contain nitrogen and can be used according to the invention there may be mentioned: 2,6-dihydroxytoluene, resorcinol, glutaric anhydride, succinic anhydride and hydroquinone-bis-hydroxyethyl ether.

The compounds cited hereinbefore as examples of compounds which can be used according to the present invention constitute merely a selection of such substances and make no claim to completeness.

The compounds which can be used according to the invention should furthermore be inert during the transfer printing process, i.e. they should have no influence on the shade of the transferable dyes nor on their fastness properties nor also on the properties of the fibres.

The amount of compound or compounds necessary to attain an optimum uptake of dye depends on the composition of the material to be printed. Whereas preferably about 5 to 300 g/kg of pretreatment liquor are used for pure cotton, it is sufficient to use an amount of 2.5 to 200 g/kg for blended fabric consisting of 67% of polyester and 33% of cotton. The amount also depends on the molecular magnitude of the compounds as defined herein. Compounds of low molecular weight are often more effective than those of high molecular weight if they are monomeric substances. In the case of condensed systems, for example polyethylene imine, the molecular weight can be 100,000.

Suitable acid acceptors are both organic and inorganic substances, for example alkali metal hydroxides, such as lithium, sodium and potassium hydroxide; alkaline earth metal hydroxides, for example beryllium, magnesium, calcium and strontium hydroxide; salts of strong bases and weak acids, for example the alkali and alkaline earth carbonates, bicarbonates, acetates, phenolates or alcoholates; bases, for example aqueous ammonia solutions; and amines, for example ethanolamine or triethanolamine, as well as acid amides.

The acid acceptor is used in an amount of 0.1 to 10 molar equivalents per molar equivalent of the reactive disperse dye. Preferably it is used in a concentration of 1 to 5 molar equivalents per molar equivalent of dye.

Suitable reactive disperse dyes for carrying out the process are those that are converted into the vapour state between 150° and 220° C., i.e. dyes whose vapour pressure is higher than $10^{-5}$ above 160° C. or which transfer to an amount of at least 50% onto the printing substrate in the course of 1 to 120 seconds. In particular, they are organic reactive disperse dyes or fluorescent brighteners of low or very low water-solubility.

Suitable reactive dyes for the process according to the invention are above all those that are normally used for transfer printing on polyester and are listed in the Colour Index under the heading "Disperse Dyes". These disperse dyes can belong to the most diverse classes, e.g. to the azo and anthraquinone classes; but quinophthalone, nitro, azomethine, styryl dyes and the like are also suitable.

Those reactive disperse dyes which are listed in the Colour Index under the heading "Vat and/or Organic Pigment Dyes" are also suitable. These are dyes of lesser water-solubility than the disperse dyes and therefore do not exhaust onto synthetic fibres or do so only to an insufficient extent, i.e. less than 50%. Such dyes have in general a molecular weight of below 700, preferably below 300 to 400.

The dyes can belong e.g. to the following classes: indigoid, thionidigoid, anthraquinoid azo, azomethine or stilbene pigment dyes; but in particular they are dyes of the azo, azomethine, stilbene or anthraquinone classes.

Suitable reactive components of the reactive disperse dyes which can be used for the process of the present invention are all fibre-reactive groups that are suitable for cellulose material.

Such groupings are, for example, the epoxy grouping, the unsaturated aliphatic acyl radicals, such as the propiolic acid, chloroacrylic acid, chlorocrotonic acid and chloromaleic acid radicals, as well as the vinyl $SO_2$ grouping. Advantageously, however, the dyes contain fibre-reactive groupings with removable substituents, for example sulphonic acid-N-$\beta$-chloroethyl amide groups, $\beta$-chloroethylsulphonyl groups, acyl radicals of aliphatic halogenated carboxylic acids, above all chloroacetyl, $\beta$-chloropropionyl, $\alpha,\beta$-dibromopropionyl and dichloropropionyl radicals and also cyclic fibre-reactive substituents of the aromatic and especially the heterocyclic series, for example the nitrochlorobenzoyl groupings, chlorobenzthiazole, mono- and dihalogeno-1,3,5-triazinyl groups, di- and trichloropyrimidyl groups, diazine and triazine radicals with removable sulphonyl groupings, and chloropyridazine radicals.

These fibre-reactive substituents are attached in the dyestuff molecule direct or through a bridge member, in particular through an oxygen, sulphur or nitrogen atom, or through a sulphamide or carbamide group, to an aromatic ring. Examples of dyes with such substituents are disclosed, for example, in French Pat. Nos. 1.198.423, 1.189.668, 1.274.098, 1.276.443, and in British Pat. Nos. 850.977, 862.269 825.377. They can be obtained by customary methods.

Suitable types of hydrophilic fibrous material are principally woven and knitted fabrics, but also nonwovens, made from polyhydroxylated natural or synthetic fibrous material, especially cellulose, for example staple fibre and, above all, cotton. Examples of synthetic fibrous material in the blends are those derived from acrylonitrile, e.g. polyacrylonitrile and copolymers of acrylonitrile and other vinyl compounds, e.g. acrylic esters, acrylic amides, vinyl pyridine, vinyl chloride or vinylidene chloride, copolymers of dicyanethylene and vinyl acetate, as well as from acrylonitrile block copolymers, materials derived from polyvinyl chloride, from cellulose triacetate and cellulose 2½-acetate, and in particular materials derived from polyamides, e.g. polyamide 6, polyamide 66 or polyamide 12, and materials derived from aromatic polyesters, such as those from terephthalic acid and ethylene glycol or 1,4-dimethylcyclohexane, and copolymers of terephthalic and isophthalic acid and ethylene glycol.

Blends of polyester/cotton and polyamide/cotton are particularly suitable.

The fibre blends can be primarily in the form of wovens, knitted fabrics, non-wovens or of webs, or they can be cut or readymade.

The inert intermediate or auxiliary carrier required for carrying out the invention, i.e. a carrier for which the substances, dyes or fluorescent brighteners used according to the invention have no affinity, is desirably a flexible, preferably stable, three-dimensional sheet material, for example a ribbon, strip or a sheet with advantageously a smooth surface, which is stable to heat and can consist of the most varied kinds of material, preferably non-textile material, e.g. metal, such as an aluminum or steel sheet or an endless ribbon of stainless steel, plastic or paper, preferably pure, non-lacquered cellulose parchment paper, which can optionally be coated with a film of vinyl resin, ethyl cellulose, polyurethane resin or teflon.

A particular embodiment of the transfer printing consists in applying only segments of the printing carrier instead of a complete web to the object to be printed. Such segments can represent different patterns, e.g. letters, flowers, comic strip illustrations and the like.

The process of the present invention can be carried out, for example, in the following manner. Printing inks, which contain at least one sublimable fibre-reactive dye or fluorescent brightener that during the heat treatment of the transfer process has a vapour pressure higher than $10^{-5}$ at temperatures above 160° C. or transfers to an amount of at least 50% onto the printing substrate over the course of 1 to 120 seconds, optionally a binder that is stable below 230° C., water and/or an organic solvent, are applied to an inert carrier and dried. The treated side of the carrier is then brought into contact with the surface of the material to be printed, which has been pretreated with an acid acceptor compound and a compound that during the heat treatment of the transfer printing process has a vapour pressure higher than $10^{-5}$ at temperatures above 160° C., or with at least one compound that simultaneously combines both functions, and dried, and then carrier and material to be printed are subjected to a heat treatment of 100° to 250° C., advantageously 170° to 220° C., for 3 to 30 seconds, optionally under mechanical pressure, and the printed material is subsequently separated from the carrier. Very good results are also obtained by carrying out the transfer process under a vacuum of preferably 15 to 150 Torr. Very brief transfer times of approximately 3 to 15 seconds at temperatures of 130° to 200° C. then suffice. Good results are also obtained by drying the previously impregnated printing substrate to only a certain degree and transferring direct onto the semi-dried material.

It is desirable to wash the printed material subsequently at 80° C. in order to remove the assistants and to improve the fastness properties.

The dyes dispersed in the printing ink should mainly have a particle size of $\leqq 10\mu$, preferably $\leqq 2\mu$.

Besides water, practically all water-miscible and water-immiscible organic solvents or solvent mixtures which boil atmospheric pressure at temperatures below 220° C., preferably below 150° C., and which have sufficient solubility or emulsifiability (dispersibility), are suitable for obtaining the printing inks.

The following may be cited as examples of suitable organic solvents: aliphatic and aromatic hydrocarbons, e.g. n-heptane, cyclohexane, petroleum ether, benzene, xylene or toluene, halogenated hydrocarbons, such as methylene chloride, trichloroethylene, perchloroethylene or chlorobenzene, nitrated aliphatic hydrocarbons, such as nitropropane, aliphatic amides, such as dimethyl formamide or mixtures thereof, also glycols such as ethylene glycol or ethylene glycol monoalkyl ethers, e.g. ethylene glycol monoethyl ether, diethyl carbonate, dimethyl carbonate, or esters of aliphatic monocarboxylic acids, e.g. ethyl acetate, propyl acetate, butyl acetate, β-ethoxyethyl acetate, aliphatic or cycloaliphatic ketones, for example methyl ethyl ketone, methyl isobutyl ketone, cyclohexanone, isophoron, mesityl oxide, or diacetone alcohol and alcohols, e.g. methanol, ethanol, and, preferably, n-propanol, isopropanol, n-butanol, tert.butanol, sec.butanol, or benzyl alcohol; also suitable are mixtures of cited solvents, e.g. a mixture of methyl ethyl ketone and ethanol in the ratio 1:1.

Particularly preferred solvents are esters, ketones, or alcohols which boil below 120° C., e.g. butyl acetate, acetone, methyl ethyl ketone, ethanol, isopropanol, or butanol.

Virtually anhydrous printing inks are used with advantage.

The desired viscosity of the printing inks can be adjusted by addition of the cited binders, or by dilution with water or a suitable solvent.

Suitable binders are synthetic, semisynthetic, and natural resins, i.e. both polymerisation and polycondensation and polyaddition products. In principle, it is possible to use all resins and binders customarily used in the printing ink and paint industry. The binders should not melt at the transfer temperature, react chemically in the air or with themselves (e.g. cross-link), have little or no affinity for the dyes used, solely maintain the transferable dyes at the printed area of the inert carrier without changing them, and remain on the carrier in their entirety after the heat transfer process. Preferred binders are those that are soluble in organic solvents and that dry rapidly for example in a warm current of air and form a fine film on the carrier. Suitable water-soluble binders are: alginate, tragacanth, carubin (from locust bean gum), dextrin, more or less etherified or esterified mucilages, hydroxyethyl cellulose or carboxymethyl cellulose, water-soluble polyacrylic amides or, above all, polyvinyl alcohol; and suitable binders that are soluble in organic solvents are cellulose esters, such as nitrocellulose acetate or butyrate, and, in particular, cellulose ethers, such as methyl, ethyl, propyl, isopropyl, benzyl, hydroxypropyl, or cyanoethyl cellulose, and also mixtures thereof.

The suitability of the printing inks can be improved by adding optional components, for example plasticisers, high boiling solvents such as e.g. tetralin or decalin, ionogenic or non-ionogenic surface active compounds, for example the condensation product of 1 mol of octylphenol with 8 to 10 mols of ethylene oxide.

The liquid, pasty or dry dyeing preparations contain in general 0.01 to 80, advantageously 1 to 30, percent by weight of at least one or more transferable reactive dyes or fluorescent brighteners and optimally 0.5 to 50 percent by weight of a binder, based on the total weight of the preparation, and can be used direct or after they have been diluted as printing inks according to the invention.

The optionally filtered printing inks are applied to the inert carrier, for example by spraying, coating, or advantageously by printing the carrier on parts of the surface or over the entire surface. It is also possible to apply a multicoloured pattern or to print successively in a base shade and subsequently with similar or different patterns.

After the printing inks have been applied to the inert carrier, these are then dried, e.g. with the aid of a flow of warm air or by infrared irradiation, optionally with recovery of the solvent employed.

The carriers can also be printed on both sides, whereby it is possible to select dissimilar colours and/or patterns for both sides. In order to avoid using a printing machine, the printing inks can be sprayed onto the carrier, for example by using a spray gun. Particularly interesting effects are obtained if more than one shade is printed or sprayed onto the carrier simultaneously. Furthermore, specific patterns can be obtained for example by using stencils or artistic patterns by using a brush. If the carriers are printed, the most diverse forms of printing methods can be employed, for example relief printing (e.g. letter press printing, flexographic printing), intaglio printing (e.g. roller printing), silkscreen printing (e.g. rotary screen printing, film screen printing) or electrostatic printing.

The pretreatment of the printing substrate is advantageously effected by applying thereto an aqueous solution, for example by spraying, padding or some other known method, and subsequently drying the substrate. If desired, the printing substrate can have a certain moisture content.

The transfer is performed in the conventional manner by the action of heat. The treated carriers are brought into contact with the textile material and kept at 100° C. to 250° C. until the transferable dyes or fluorescent brighteners applied to the carrier are transferred to the material. As a rule 3 to 60 seconds suffice for this.

The heat can be applied in various known ways, e.g. by passage through a hot heater drum, a tunnel-shaped heating zone or by means of a heated cylinder, advantageously in the presence of an unheated or heated backing roll which exerts pressure, or of a hot calender, or also by means of a heated plate (iron or warm press), optionally in vacuo, the various devices being preheated by steam, oil, infrared irradiation or microwaves to the required temperature or being located in a preheated heating chamber.

Upon completion of the heat treatment the printed goods are removed from the carrier.

Compared with known processes, the process according to the invention has notable advantages. The present process has in particular the principal advantage of obtaining strong dyeings and prints which are fast to wet treatments and light on hydrophilic fibrous material and blends thereof with synthetic fibrous material by the heat transfer process while maintaining optimum mechanical fibre properties. The prints obtained by the novel process are characterised by sharply dilineated, fine contours. The greatest advantage of the novel process is, however, that blends of woven or knitted fabrics made from hydrophilic and synthetic fibrous material can be printed or dyed in solid shades and that very good fastness properties are obtained on the different types of fibre.

The following Examples illustrate the invention but do not in any way limit the scope thereof. Parts and percentages are by weight.

EXAMPLE 1

(a) With cooling, 5 parts of the orange dye of formula

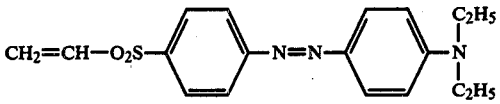

6.5 parts of ethyl cellulose and 88.5 parts of ethanol or methyl ethyl ketone are ground for 4 hours in a glass bead mill. The glass beads are then separated from the grinding stock to yield a printing ink with good dispersion of the dye. This printing ink is printed on paper to give a paper carrier suitable for the transfer printing process.

(b) A polyester/cotton fabric (67/33) is impregnated cold with a treatment liquor consisting of 100 parts of butanediol glycidyl ether as transfer assistant, 5 parts of sodium carbonate and 5 parts of borax as acid acceptors, and 890 parts of water, and dried in the air.

(c) The dye of the paper carrier obtained in a) is transferred to the polyester/cotton fabric pretreated as in b) on an ironing machine for 30 seconds at 210° C. After the transfer, the printed material is rinsed cold and soaped for 15 minutes at 80° C. with 1 g/l of a non-ionogenic detergent. A strong, orange print with good solidity and with very good fastness properties is obtained.

By repeating the above procedure, but not using a pretreated polyester/cotton fabric, a substantially fainter and very skittery print is obtained, since the cotton takes up practically no dye.

EXAMPLE 2

A strong, orange coloured print with a good tone-in-tone shade is also obtained by repeating the procedure of Example 1, but using methoxypolyethylene glycol (molecular weight 430) instead of butanediol diglycidyl ether.

EXAMPLE 3

A strong, reddish orange print with good solidity and good fastness properties is obtained by repeating the procedure of Example 1, but using the following dye

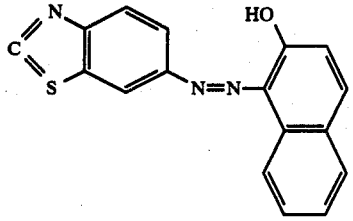

EXAMPLE 4

A polyester/cotton fabric (67/33) is impregnated cold with a treatment liquor consisting of 10 parts of polyethylene imine (molecular weight 40,000), 10 parts of cyanamide and 980 parts of water, and dried in the air. Using an ironing machine, the dye of formula

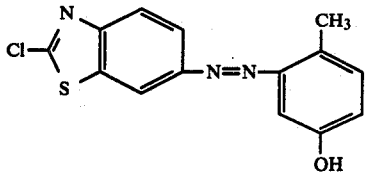

which is on a carrier obtained as in Example 1 (a), is subsequently transferred to the pretreated fabric over the course of 30 seconds at 200° C. The resultant print is treated twice briefly at boiling temperature with a 1:1 solution of dimethyl formamide/water to yield a yellow print with good solidity and good fastness to rubbing and wet treatments.

EXAMPLE 5

A polyester/cotton fabric (67/33) is impregnated at room temperature with a treatment liquor consisting of 10 parts of polyethylene imine (molecular weight ~40,000) and 990 parts of water, and dried in the air. The dye of formula

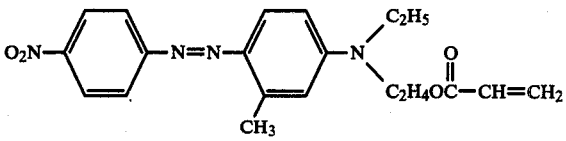

which is present on a carrier obtained according to Example 1 (a), is transferred to the pretreated polyester/cotton fabric on an ironing machine for 30 seconds at 210° C. The resultant print is treated twice for 5 minutes at 80° C. with a perchloroethylene liquor and dried. A scarlet print with good solidity and good fastness to rubbing and wet treatments is obtained. By repeating the above procedure, but omitting the pre-impregnation, a very skittery print is obtained, since the cotton takes up practically no dye.

EXAMPLE 6

The procedure of Example 5 is repeated using the dye of formula

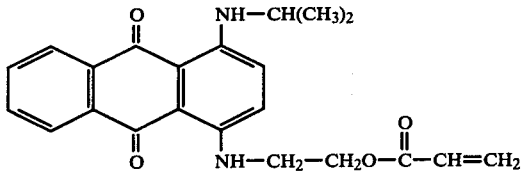

to give a blue print with good fastness to rubbing and good wet fastness properties.

EXAMPLE 7

A cotton fabric is impregnated at room temperature with a treatment liquor consisting of 10 parts of polyethylene imine (molecular weight 40,000), 10 parts of cyanamide and 980 parts of water, and dried in the air. The dye of formula

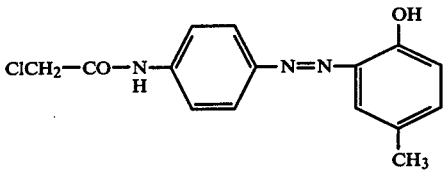

which is present on a carrier obtained according to Example 1 (a), is transferred to the pretreated cotton fabric on an ironing machine for 30 seconds at 200° C. The resultant print is then treated for 5 minutes at 60° C. with a perchloroethylene liquor containing 5 g/l of a cleansing agent, such as di-n-dodecyldimethylammonium chloride, and rinsed with perchloroethylene at 60° C.

A yellow print with good fastness to rubbing and good wet fastness properties is obtained.

EXAMPLE 8

The procedure of Example 7 is repeated using the dye of formula

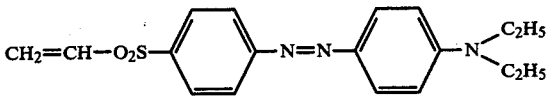

to give an orange coloured print with good fastness to rubbing and good wet fastness properties.

EXAMPLE 9

A polyamide/cotton fabric (67/33) is impregnated cold with a treatment liquor consisting of 10 parts of polyethylene imine (molecular weight 40,000), 10 parts of cyanamide and 980 parts of water, and dried in the air. The dye of formula

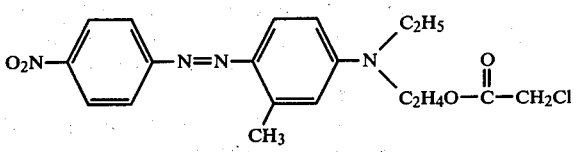

which is present on a carrier obtained according to Example 1 (a), is transferred to the pretreated polyamide/cotton fabric on an ironing machine for 30 seconds at 210° C.

The resultant print is given an aftertreatment with a perchloroethylene liquor containing 2 g/l of a cleansing agent, such as di-n-dodecyldimethylammonium chloride, for 5 minutes at 60° C. and rinsed with cold perchloroethylenen. A scarlet print with a good solidity and with good fastness to rubbing and good wet fastness properties is obtained.

I claim:

1. In a transfer printing process for dyeing or optically brightening a hydrophilic fibrous material or a blend of a hydrophilic and a synthetic fibrous material which comprises bringing a treated and dried carrier into contact with the material to be dyed or optically brightened and applying heat to effect transfer of dye or optical brightening agent from the carrier to the said material, the improvement according to which the carrier bears at least one sublimable organic reactive disperse dye or fluorescent optical brightening agent which, during the heat treatment of the transfer printing process, has a vapour pressure higher than $10^{-5}$ Torr at temperatures above 160° C. or transfers to an amount of at least 50% onto the said fibrous material during a time period of from 1 to 120 seconds and wherein, prior to the heat transfer step, the fibrous material to be printed is pretreated with (a) at least two compounds which are inert to the dyes, brighteners and fibrous material during the transfer, the first one of which has a boiling point higher than 120° C. and a solubility or dispersibility in water, either directly or with the aid of an auxiliary solvent or dispersant, of at least 25 g/l at 25° C. and which, under the conditions of transfer of the dyes or fluorescent brighteners is sparingly volatile, said first compound being selected from the group consisting of 2,6-dihydroxytoluene, resorcinol, glutaric anhydride, succinic anhydride, hydroquinone-bis-hydroxyethyl ether, butanediol glycidyl ether and methoxypolyethylene glycol, the other compound being an organic or inorganic acid acceptor, or (b) at least one compound inert to the dyes, brighteners and fibrous material during the transfer and which possesses the characteristics of both of the compounds under (a), and selected from the group consisting of amines, amides, imides, imines, unsubstituted and substituted ureas and thioureas or 5- to 7-membered saturated or unsaturated heterocyclic ring compounds which contain as ring members at least one of the groups or atoms N, S, O, NH, CO, =CH, $CH_2$ and which can be substituted by alkyl of 1 to 4 carbon atoms, OH, $NH_2$, hydroxyalkyl of 1 to 3 carbon atoms or halogen, said treated fibrous material being dried prior to contacting with the treated carrier.

2. A process according to claim 1 wherein the carrier is prepared by applying to an inert carrier sheet at least one printing ink comprising the said dye or optical brightener in admixture with water, organic solvent or mixtures thereof and drying the thus obtained carrier sheet.

3. A process according to claim 2 wherein the printing ink contains a binder that is stable at a temperature below 230° C.

4. A process according to claim 2 wherein the heat transfer is effected by subjecting the carrier and fibrous material to a temperature of 100° C. to 250° C. for from 3 to 60 seconds.

5. A process according to claim 4 wherein the heat transfer is effected while applying mechanical pressure to the joined carrier and material to be printed.

6. A process according to claim 4 wherein the transfer is effected under a vacuum of 15 to 150 Torr.

7. A process according to claim 1 wherein the material is a member selected from the group of imidazole, 2-methylimidazole, hydantoin, 1-N-hydroxymethyl-5-dimethyl hydantoin, succinimide, N-hydroxysuccinimide, nicotinic amide, pyrazinecarboxylic amide and polyethylene imine.

8. A process according to claim 1 wherein the material is a compound of the formula

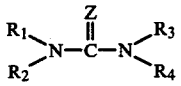

wherein Z represents O or S and each of $R_1$, $R_2$, $R_3$ and $R_4$ independently represents hydrogen, alkyl of 1 to 8 carbon atoms, cycloalkyl or aryl, which can be substituted by OH, CN, $NH_2$, halogen, hydroxyalkyl of 1 to 3 carbon atoms, or $R_1$ and $R_2$ or $R_3$ and $R_4$, together with the nitrogen atom to which they are attached, or $R_1$ and $R_3$ and $R_2$ and $R_4$, together with the bridge member -N-CZ-N- to which they are attached, form a heterocyclic ring which optionally contains further heteroatoms from the group of oxygen, sulphur and nitrogen atoms.

9. A process according to claim 8 which comprises the use of N-ethyl urea, N-methyl urea, N-methyl thiourea, N,N'-ethylene urea, N,N'-dimethyl thiourea, 2-imidazolidone, thiourea, N,N'-propylene thiourea, N-iso-butyl thiourea or N,N-butylene thiourea.

10. A process according to claim 1 wherein the material is a compound of the formula $$R—CO—NH_2$$

wherein R represents aryl, aralkyl, or represents a 5- to 7-membered saturated or unsaturated heterocyclic ring, which can be substituted by halogen, OH, CN, $NH_2$ or hydroxyalkyl of 1 to 3 carbon atoms.

11. A process according to claim 1 wherein the material is a compound of the formula

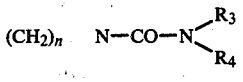

(3)

wherein A represents the —CH=CH or $(CH_2)_n$ group (n=1 to 6), which can contain halogen or OH, CH, $NH_2$ and hydroxyalkyl of 1 to 3 carbon atoms, and B represents —OH, —CN, —$NH_2$ or hydroxyalkyl of 1 to 4 carbon atoms.

12. A process according to claim 11 wherein the compound is N-hydroxysuccinimide or N-hydroxymethylsuccinimide.

13. A process according to claim 1 wherein the sublimable reactive disperse dyes have a molecular weight below 700 and a vapour pressure at atmospheric pressure higher than $10^{-5}$ Torr at temperatures above 160° C.

14. A process according to claim 1 wherein the fibrous material to be printed is cotton, a blend of polyester and cotton or a blend of polyamide and cotton.

15. A process according to claim 4 wherein the carrier and material to be printed are subjected to a heat treatment of 170° to 220° C. for 3 to 30 seconds.

16. A process according to claim 4 wherein the carrier and material to be printed are subjected to a heat treatment of 130° to 200° C. for 3 to 30 seconds under a vacuum of 15 to 150 Torr.

17. A hydrophilic fibrous material or a blend of a hydrophilic fibrous material with a synthetic fibrous material dyed or optically brightened according to the process of claim 1.

* * * * *